United States Patent [19]

Bertucci

[11] 4,072,311

[45] Feb. 7, 1978

[54] INDEX FINGER POSITIONING DEVICE FOR TENNIS RACKET HANDLES

[76] Inventor: Shirley J. Bertucci, 6126 St. Charles Ave., New Orleans, La. 70118

[21] Appl. No.: 501,972

[22] Filed: Aug. 30, 1974

[51] Int. Cl.[2] ..... A63B 69/38

[52] U.S. Cl. ..... 273/75

[58] Field of Search ..... 273/67 DA, 72 R, 73 J, 273/75, 81 R, 81 B, 81 D, 81.4–81.6, 165

[56] References Cited

U.S. PATENT DOCUMENTS

| | | | |
|---|---|---|---|
| 412,479 | 10/1889 | Davis | 273/75 UX |
| 715,225 | 12/1902 | Whitner | 273/165 |
| 1,694,992 | 12/1928 | Stoeffler | 273/165 |
| 1,822,212 | 9/1931 | Griffiths | 273/81.4 |
| 1,917,236 | 7/1933 | Bloomstrand | 273/75 UX |
| 2,091,458 | 8/1937 | Sleight | 273/72 R |
| 2,166,045 | 7/1939 | Fletcher | 273/75 |
| 2,484,762 | 10/1949 | Strazza | 273/165 |
| 2,962,288 | 11/1960 | Lowden | 273/165 |
| 3,084,938 | 4/1963 | Kapanowski | 273/165 X |
| 3,227,455 | 1/1966 | Hulsman | 273/165 |
| 3,817,521 | 6/1974 | Wright | 273/75 |
| 3,860,243 | 1/1975 | Prisco | 273/165 |

FOREIGN PATENT DOCUMENTS

| | | | |
|---|---|---|---|
| 369,888 | 9/1930 | United Kingdom | 273/81.4 |
| 27,827 of | 1897 | United Kingdom | 273/75 |
| 211,792 | 2/1924 | United Kingdom | 273/75 |
| 407,270 | 3/1934 | United Kingdom | 273/75 |

OTHER PUBLICATIONS

"The Sporting Goods Dealer"; Mar. 1970; p. 245.

*Primary Examiner*—Richard J. Apley
*Attorney, Agent, or Firm*—Wilkinson, Mawhinney & Theibault

[57] ABSTRACT

The present disclosure is directed to a device which may be applied to the handle of a tennis racket and which is generally of an obtuse triangular construction having rounded ends and sides and which is tapered from its base towards its apex and which is to be installed with its long side generally transversely of the major axis of the racket handle to separate the index finger from the remaining fingers and which is light in weight, durable and inexpensive to manufacture.

1 Claim, 7 Drawing Figures

INDEX FINGER POSITIONING DEVICE FOR TENNIS RACKET HANDLES

An object of the present invention is to provide an attachment for the handle of a tennis racket which may be easily installed on the handle even by an amateur without requiring pro-assistance and which does not upset the balance or appearance of the racket while emphasizing and encouraging the use of the index finger for applying more power during serve, forehand and backhand drive positions.

A further object of the present invention is the provision of an attachment for the handle of a tennis racket which may be applied without tools or defacement of the handle and which will permit use of the handle in one grip employing the attachment to separate the index finger from the remaining fingers for increased drive in forehand and backhand strokes and which when the handle is flipped or rotated 180° in the hand of the player will permit conventional grasping of the handle without interference of the attachment during the serve.

A still further object of the present invention is to provide a compact smooth attachment not having a bulky configuration with sharp edges which could cause injury to a player.

Another object of the present invention is to provide an attachment for carrying out the objectives announced in U.S. Pat. No. 3,817,521 with a lighter weight more compact attachment not requiring tools for attachment and not altering the balance or weight of the racket and without interfering with playing with the racket employing conventional grips and which may be made of a number of lightweight inexpensive durable materials and which does not offend the aesthetics appearance of the racket and upset its smooth flow visual attractiveness.

With the foregoing and other objects in view the invention will be more fully described hereinafter and more particularly pointed out in the appended claims.

In the drawings in which like parts are denoted by reference characters throughout the several views.

Figure 1:
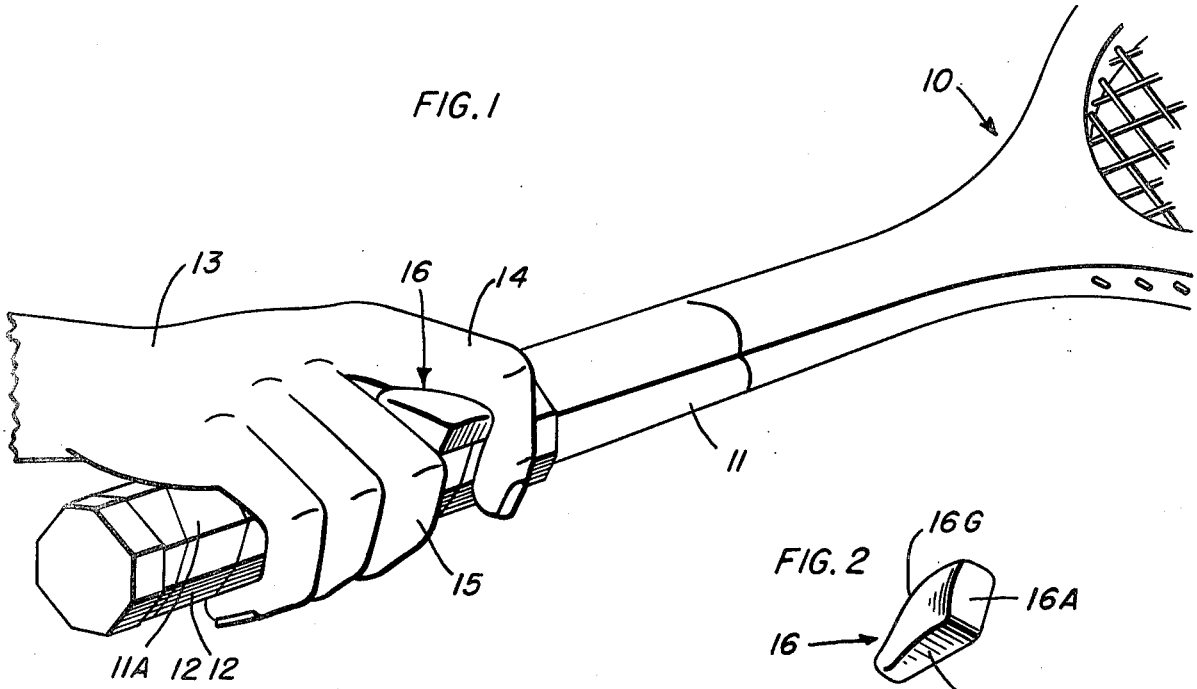
FIG. 1 is a perspective view of a tennis racket in the hand of a player with the index finger positioning device of the present invention installed on the handle.
Figure 2:
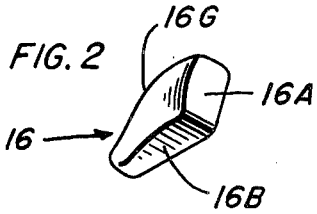
FIG. 2 is a perspective view of the index finger positioning device of the present invention.
Figure 3:
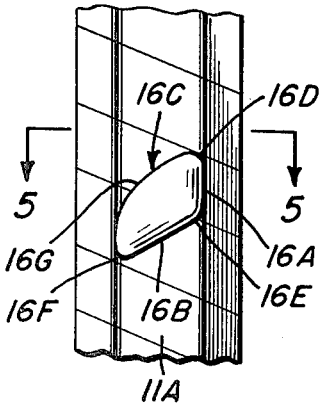
FIG. 3 is a top plan view of a section of a tennis racket handle showing the index finger positioning device installed thereon.

Referring now to the drawings and for the moment to FIG. 1, 10 designates generally a tennis racket having a handle 11 with a grip 12 which is grasped by the players hand 13. Between the index finger 14 and middle finger 15 is located the index finger positioning device 16 of the present invention.

As best seen in FIGS. 2 through 5, the finger engaging means is generally of an obtuse triangular construction having a base 16A, long side 16B and hypotenuse

Figure 4:
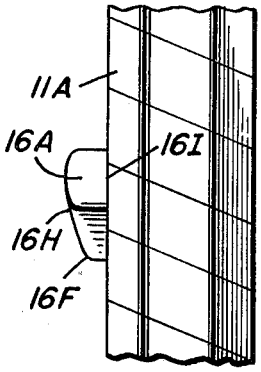
FIG. 4 is a side elevational view of the handle of FIG. 3.
Figure 5:
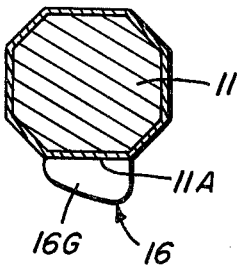
FIG. 5 is a vertical sectional view taken on the lines 5—5 in FIG. 3.

16C. Each of the sides are joined by rounded corners 16D, 16E and 16F. The hypotenuse 16C rather than being a straight line is a long sweeping curve 16G. As best seen in FIG. 4, the device tapers from its base 16A toward its apex 16F along line 16H. As a three dimensional triangle the device has a flat surface 16I on its side opposite the tapered side 16H, to facilitate its attachment to the at least one flat side 11A of the racket handle 11, by cement, glue, epoxy resin or even tape, once the position along the axial length of the handle has been determined by the size of the hand of the racket owner. All human hands not being of the same size each racket owner need only properly grasp the racket handle and insert the device 16 between the index finger 14 and the long finger 15, in FIG. 1, with the base 16A aligned with the edge of said at least one flat side 11A to cause the index finger 14 to be properly extended, mark the position on the handle with any suitable marking device such as a scribe, chalk or pencil and then remove the hand, apply cement or other bonding material to the flat side 16I placing it back on the at least one flat side of the handle at the marked place and allowing it to set up. The racket is now ready for play.

The device may be of a moldable plastic material such as nylon, polypropylene or it may be cast of metal such as aluminum or a lightweight alloy or it may even be formed of wood. The material selected should be of lightweight and strong.

Figure 6:
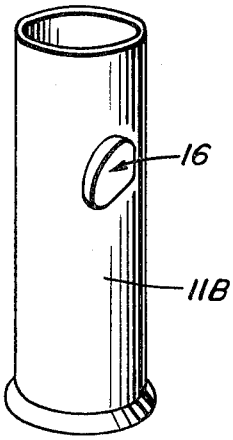
FIG. 6 is a perspective view of the index finger positioning device installed on a sleeve slidable over the handle of a tennis racket.

Referring now to FIG. 6, a modified form of the invention is shown in which the finger positioning device 16 is shown molded on a flexible sleeve 11B which is receivable over the free end of the grip 12 on handle 11 of racket 10. Small medium and large sleeves with the devices 16 thereon may be made, the size difference relating to the positioning of the device 16 relative to the bottom of the racket handle.

Figure 7:
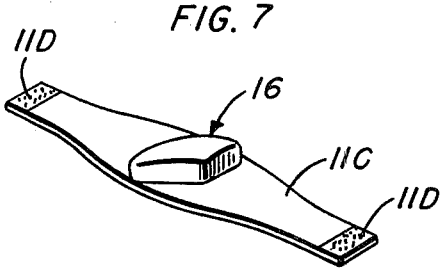
FIG. 7 is a perspective view of the device of the present invention on an attaching and mounting strip.

As best seen in FIG. 7, the index finger positioning device 16 is bonded or other wise secured to a flexible mount strap 11C having for example pressure sensitive adhesive at 11D so that the strap may be wrapped about the grip 12 at the proper point along the grip for the hand size of the racket owner. The two pressure sensitive adhesive areas 11D are pressed together to lock the device firmly in place on the grip.

What I claim is:

1. In combination, a tennis racket having a handle and ball striking head, said handle having at least one flat side lying in the plane of said ball striking head, an index finger positioning device comprising an upstanding finger engaging means positioned on said at least one flat side at a point along its length to lie between the index finger and the middle finger when the racket is grasped by a player in a playing position, said upstanding finger engaging means in plan view being generally of an obtuse triangular construction having rounded ends and in a side elevation being tapered upwardly on a curve from its base toward its apex with the long side being positioned angularly across the major axis of the handle and the base being substantially parallel to the major axis of the handle and being aligned with the edge of said at least one flat side and upstanding therefrom, said finger engaging means being in a fixed position along the axis of the racket handle dependent upon the side of the players hand and playing grip, and securing means positively locating and maintaining said upstanding finger engaging means on said handle in said fixed position.

* * * * *